US006644041B1

(12) United States Patent
Eyermann

(10) Patent No.: US 6,644,041 B1
(45) Date of Patent: Nov. 11, 2003

(54) SYSTEM IN PROCESS FOR THE VAPORIZATION OF LIQUEFIED NATURAL GAS

(76) Inventor: Volker Eyermann, 2111 Welch St., #B-321, Houston, TX (US) 77019

( * ) Notice: Subject to any disclaimer, the term of this patent is extended or adjusted under 35 U.S.C. 154(b) by 0 days.

(21) Appl. No.: 10/294,000

(22) Filed: Nov. 14, 2002

Related U.S. Application Data

(63) Continuation-in-part of application No. 10/161,431, filed on Jun. 3, 2002.

(51) Int. Cl.[7] ..... G17C 9/02
(52) U.S. Cl. ..... 62/50.2
(58) Field of Search ..... 62/50.2; 261/DIG. 11, 261/157, 152

(56) References Cited

U.S. PATENT DOCUMENTS 3,229,472 A * 1/1966 Beers ..... 62/50.3
4,224,802 A * 9/1980 Ooka ..... 62/50.2
4,331,129 A * 5/1982 Hong et al. ..... 126/611
4,519,213 A * 5/1985 Brigham et al. ..... 62/50.2
6,367,258 B1 * 4/2002 Wen et al. ..... 60/641.7
6,367,429 B2 * 4/2002 Iwasaki et al. ..... 122/31.1
2001/0042376 A1 * 11/2001 Johnson et al. ..... 62/48.2

* cited by examiner

*Primary Examiner*—William C. Doerrler
(74) *Attorney, Agent, or Firm*—Harrison & Egbert

(57) ABSTRACT

A process for vaporizing liquefied natural gas including passing water into a water tower so as to elevate a temperature of the water, pumping the elevated temperature water through a first heat exchanger, passing a circulating fluid through the first heat exchanger so as to transfer heat from the elevated temperature water into the circulating fluid, passing the liquefied natural gas into a second heat exchanger, pumping the heated circulating fluid from the first heat exchanger into the second heat exchanger so as to transfer heat from the circulating fluid to the liquefied natural gas, and discharging vaporized natural gas from the second heat exchanger.

17 Claims, 1 Drawing Sheet

SYSTEM IN PROCESS FOR THE VAPORIZATION OF LIQUEFIED NATURAL GAS

RELATED U.S. APPLICATIONS

The present is a continuation-in-part of U.S. application Ser. No. 10/161,431 filed on Jun. 3, 2002, and entitled "Apparatus and process for Vaporizing Liquefied Natural Gas (LNG)", presently pending.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to systems and processes for vaporizing liquefied natural gas. More particularly, the present invention relates to processes and systems whereby liquefied natural gas is vaporized by heat exchange action imparted onto a circulating fluid by heated water. More particularly, the present invention relates to a process and system for the vaporizing of liquefied natural gas where the heated water is elevated in temperature by the blower action of a water tower.

BACKGROUND OF THE INVENTION

Natural gas often is available in areas remote from where it ultimately will be used. Often, shipment of such natural gas involves marine transportation which makes it desirable to bulk transfer the natural gas by liquefying the natural gas so as to greatly reduce its volume for transportation at essentially atmospheric pressure. Under these conditions, the liquefied natural gas is at a temperature of approximately −162° C., though heavier hydrocarbons (such as, for example, ethane, propane, butane, and the like) often vary the boiling point of the liquefied natural gas slightly. Heretofore, a wide variety of heat transfer fluids, systems, and processes, have been proposed for the regasification or vaporization of liquefied natural gas.

In many circumstances, hot water or steam is used to heat the liquefied gas for vaporization. Unfortunately, such hot water or steam often freezes so as to give rise to the hazard of clogging up the evaporator. Various improvements in this process have heretofore been made. The evaporators presently used are mainly of the open rack type, intermediate fluid type and submerged combustion type.

Open rack-type evaporators use sea water as a heat source for countercurrent heat exchange with liquefied natural gas. Evaporators of this type are free of clogging due to freezing, easy to operate and to maintain and are accordingly widely used. However, they inevitably involve icing up on the surface of the lower portion of the heat transfer tube. This consequently produces increased resistance to heat transfer so that the evaporator must be designed to have an increased transfer area, which entails a higher equipment cost. To ensure improved heat efficiency, evaporators of this type include an aluminum alloy heat transfer tube of a special configuration. These types of evaporators are economically disadvantageous.

Instead of vaporizing liquefied natural gas by direct heating with water or steam, evaporators of the intermediate fluid type use propane, fluorinated hydrocarbons or like refrigerant having a low freezing point. The refrigerant is heated with hot water or steam first to utilize the evaporation and condensation of the refrigerant for the vaporization of liquefied natural gas. Evaporators of this type are less expensive to build than those of the open rack-type but require heating means, such as a burner, for the preparation of hot water or steam and are therefore costly to operate due to fuel consumption.

Evaporators of the submerged combustion type comprise a tube immersed in water which is heated with a combustion gas injected thereinto from a burner. Like the intermediate fluid type, the evaporators of the submerged combustion type involve a fuel cost and are expensive to operate.

In the past, various patents have issued for processes and apparatus for the vaporization of liquefied natural gas. For example, U.S. Pat. No. 4,170,115, issued on Oct. 9, 1979 to Ooka et al., describes an apparatus for vaporizing liquefied natural gas using estuarine water. This system is arranged in a series of heat exchangers of the indirect heating, intermediate fluid type. A multitubular concurrent heat exchanger is also utilized in conjunction with a multitubular countercurrent heat exchanger. As a result, salt water is used for the vaporization process. U.S. Pat. No. 4,224,802, issued on Sep. 30, 1980 to the same inventor, describes a variation on this type and also uses estuarine water in a multitubular heat exchanger.

U.S. Pat. No. 4,331,129, issued on May 25, 1982 to Hong et al., teaches the utilization of solar energy for LNG vaporization. The solar energy is used for heating a second fluid, such as water. This second fluid is passed into heat exchange relationship with the liquefied natural gas. The water contains a anti-freeze additive so as to prevent freezing of the water during the vaporization process.

U.S. Pat. No. 4,399,660, issued on Aug. 23, 1983 to Vogler, Jr. et al., describes an atmospheric vaporizer suitable for vaporizing cryogenic liquids on a continuous basis. This device employs heat absorbed from the ambient air. At least three substantially vertical passes are piped together. Each pass includes a center tube with a plurality of fins substantially equally spaced around the tube.

U.S. Pat. No. 5,251,452, issued on Oct. 12, 1993 to L. Z. Widder, also discloses an ambient air vaporizer and heater for cryogenic liquids. This apparatus utilizes a plurality of vertically mounted and parallelly connected heat exchange tubes. Each tube has a plurality of external fins and a plurality of internal peripheral passageways symmetrically arranged in fluid communication with a central opening. A solid bar extends within the central opening for a predetermined length of each tube to increase the rate of heat transfer between the cryogenic fluid in its vapor phase and the ambient air. The fluid is raised from its boiling point at the bottom of the tubes to a temperature at the top suitable for manufacturing and other operations.

U.S. Pat. No. 5,819,542, issued on Oct. 13, 1998 to Christiansen et al., teaches a heat exchange device having a first heat exchanger for evaporation of LNG and a second heat exchanger for superheating of gaseous natural gas. The heat exchangers are arranged for heating these fluids by means of a heating medium and having an outlet which is connected to a mixing device for mixing the heated fluids with the corresponding unheated fluids. The heat exchangers comprise a common housing in which they are provided with separate passages for the fluids. The mixing device, constitutes a unit together with the housing and has a single mixing chamber with one single fluid outlet. In separate passages, there are provided valves for the supply of LNG in the housing and in the mixing chamber.

It is an object of the present invention to provide a process and system whereby liquefied natural gas can be vaporized at minimal cost.

It is another object of the present invention to provide a process and apparatus whereby ambient air can be utilized to provide the heat for the LNG vaporization process.

It is still another object of the present invention to provide a system and process to provide a heat exchange process for the vaporization of liquefied natural gas which is relatively inexpensive, easy to implement and easy to use.

These and other objects and advantages of the present invention will become apparent from a reading of the attached specification and appended claims.

BRIEF SUMMARY OF THE INVENTION

The present invention is a process for vaporizing liquefied natural gas comprising the steps of: (1) passing water into a water tower so as to elevate the temperature of the water; (2) pumping the elevated temperature water through a first heat exchanger; (3) passing a circulating fluid through the first heat exchanger so as to transfer heat from the elevated temperature water into the circulating fluid; (4) passing the liquefied natural gas into a second heat exchanger; (5) pumping the heated circulating fluid from the first heat exchanger into the second heat exchanger so as to transfer heat from the circulating fluid to the liquefied natural gas; and (6) discharging vaporized natural gas from the second heat exchanger.

In the process of the present invention, the step of passing water comprises distributing the water over an interior surface of the water tower and drawing ambient air through the water tower across the distributed water so as to transfer heat from the ambient air into the water. In the preferred embodiment of the present invention, the ambient air will have dry bulb air temperature in excess of 73° F. The moisture from the air is condensed within the water tower and this condensed moisture is then drained from the water tower. The cooled air is exhausted from a top of the water tower after the ambient air is drawn across the distributed water. The water tower is formed with a plurality of baffles therein. A blower is positioned at a top of the water tower. The water tower is a plurality of openings formed in a wall thereof adjacent the respective plurality of baffles. The step of drawing in ambient air comprises passing the ambient air through the plurality of openings so as to be in close proximity to the water distributed over the plurality of baffles. A water basin is secured to the bottom of the water tower. This water basin is positioned to collect the heated distributed water. The heated distributed water from the water basin is pumped to the first heat exchanger.

In the method of the present invention, water from the first heat exchanger is pumped to the water tower after the heat is transferred into the circulating fluid.

The second heat exchanger is a shell-and-tubes heat exchanger. The heated circulating fluid is passed within the shell and arround the tubes of the second heat exchanger. The liquefied natural gas passes through the tubes in the second heat exchanger. The circulating fluid from the second heat exchanger is pumped to the first heat exchanger after the heat is transferred from the circulating fluid into the liquefied natural gas.

In the method of the present invention, an auxiliary source for heating the circulating fluid is provided in those circumstances where the ambient temperature of the air is less than 73° F. In particular, another quantity of circulating fluid is heated by a heating source other than the water tower. This heated circulating fluid is then passed into the second heat exchanger. In the preferred embodiment of present invention, the secondary heating source is a gas-fired boiler. A small portion of the discharged natural gas must be passed to the boiler so as to be fired for the heating of the circulating fluid.

The present invention is also a system for the vaporizing of liquefied natural gas comprising a water tower means having a water inlet line and a water outlet line, a first heat exchange means connected to the water outlet line such that the heated water passes therethrough, and a second heat exchange means having a liquefied natural gas therein. The water tower means serves to heat the water passed from the water inlet line therein such that the heated water passes to the water outlet line. The first heat exchange means has a circulating fluid line extending therein in heat exchange relationship with the water outlet line. The first heat exchange means serves to transfer heat from the heated water in the water outlet line into the circulating fluid in the circulating fluid line. The circulating fluid line extends in the second heat exchange means in heat exchange relationship with the liquefied natural gas line. The second heat exchange means serves to transfer heat from the heated circulating fluid into the liquefied natural gas in the liquefied natural gas line. The second heat exchange means has a vaporized gas outlet extending therefrom.

DETAILED DESCRIPTION OF THE INVENTION

Figure 1:
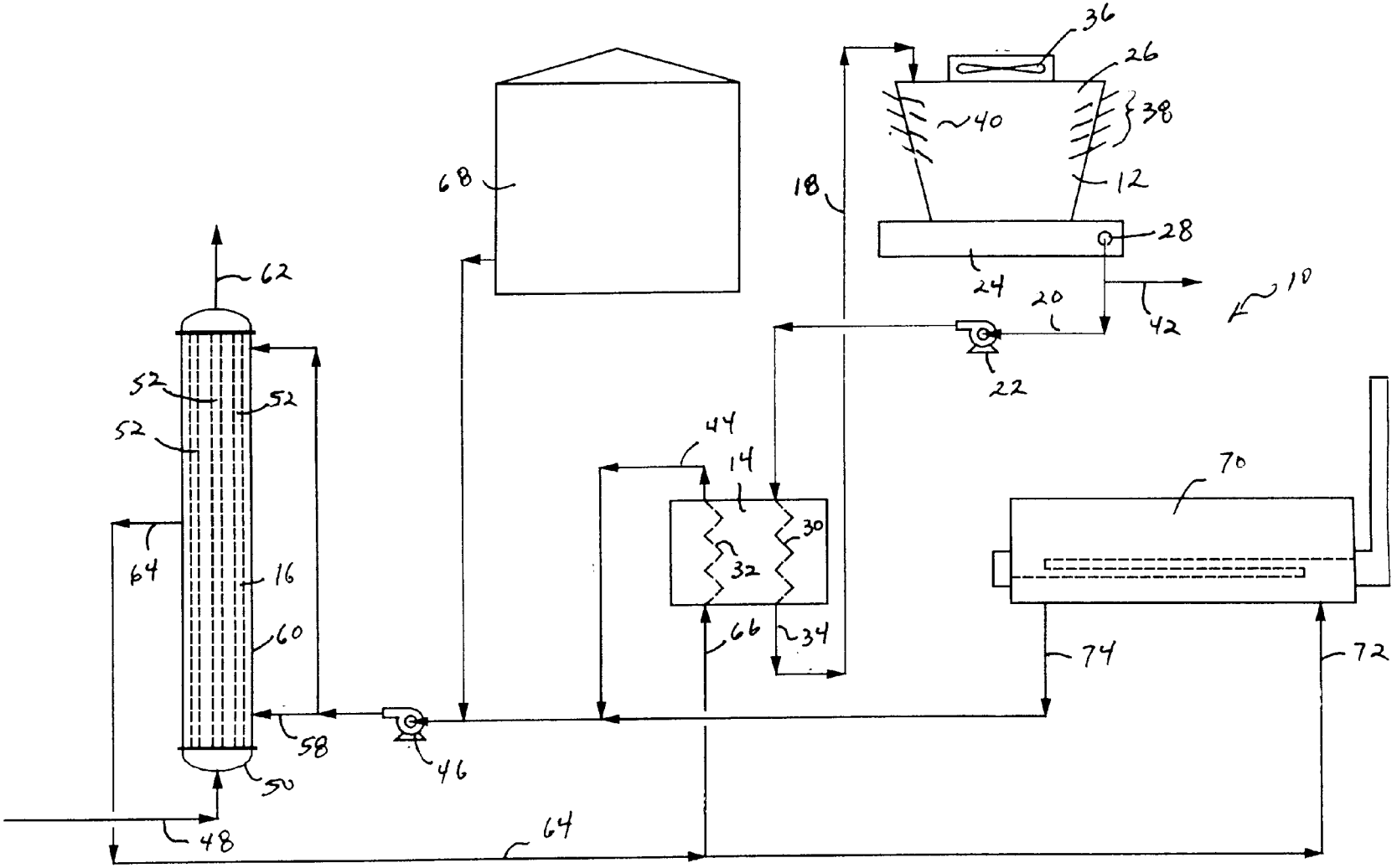
FIG. 1 is a schematic diagram showing the system and process of the preferred embodiment of the present invention.

Referring to FIG. 1, there is shown the process for the vaporization of liquefied natural gas in accordance with the preferred embodiment of the present invention. The process 10 includes a water tower 12, a first heat exchanger 14 and second heat exchanger 16. The water tower 12 has a water inlet line 18 and a water outlet line 20. The water inlet line 18 will deliver cooled water into the interior of the water tower 12. The water outlet line 20 will pass the heated water from the interior of the water tower 12 outwardly therefrom. A pump 22 will serve to draw the heated water from the water basin 24 at the bottom of the chamber 26 of the water tower 12. The pump 22 will pass the heated water from the water outlet 28 to the first heat exchanger 14. The heated water will pass through suitable fins, coils, and other passages in the first heat exchanger 14 so as to transfer heat from the heated water into a circulating fluid passing to the second heat exchanger 16. After the heat from the heated water passing through coil 30 in the first heat exchanger 14 has been transferred to the circulating fluid in the coil 32, the cooled water is passed through an outlet 34 of the first heat exchanger 14. The cooled water from outlet 34 can then pass back for heating along water inlet line 18 to the tower 12.

In the present invention, the tower 12 is in a nature of a "cooling tower." However, it is important in present invention that the water tower 12 operate in high temperature environments. For example, in the Gulf Coast of Texas, ambient air temperatures can often exceed 100° F. As such, when such heated air is drawn through the water tower 12, it will contact cooled water passed thereinto so as to greatly elevate the temperature of the water. A blower 36 is positioned at the top of the chamber 26 of water tower 12. Blower 36 will draw the heated air through opening 38 formed on the sides of the chamber 26 of water tower 12. Similarly, the heated water will be distributed over baffles 40 formed on the interior of chamber 26 of water tower 12. As a result, the cooled water delivered by water inlet line 18 will be distributed over a relatively large surface area on the interior of chamber 26. As heated air is drawn through openings 38, the air will pass in proximity over the widely distributed water on the interior of chamber 26. As such, a heat exchange effect will occur which will greatly elevate the temperature of the water within the tower 12. The blower 36 will ultimately pass cold air outwardly of the top of the water tower 12. Since the cold temperature of the water in the water inlet line 18 cools the air below the dew point of water, moisture from the air will condense in variable quantities. As a result, this moisture will have to be drained from the system by way of pipe 42. Ultimately, when the blower 36 draws the warm ambient air through the chamber 26 of water tower 12, the water is warmed and slowly cascades to the surge basin 24 as warm water. Pump 22 will draw the warm water from the basin 24 back into the first heat exchanger 14.

The first heat exchanger 14 is formed of a common type of exchanger in which the heated water passing through coil 30 is heat transfer relationship with the circulating fluid passing through coil 32. Coil 32 is directed to the outlet line 44 toward the suction side of pump 46. Pump 46 will then pass the heated circulating fluid into the interior of the second heat exchanger 16. The second heat exchanger 16 is a shell-and-tubes heat exchanger of a known configuration. Liquefied natural gas will pass along pipe 48 into the bottom 50 of the second heat exchanger 16. A suitable manifold will distribute the liquefied natural gas into the tubes 52 on the interior of the second heat exchanger 16. The heated circulating fluid is pumped through a circulating fluid inlet 58 and into the interior of shell 60 of the second heat exchanger 16. As such, the heated circulating fluid will be in heat exchange relationship with the tubes 52 for the purposes of elevating the temperature of the liquefied natural gas within tubes 52. Ultimately, the temperature of the liquefied natural gas will be such an extent that the vaporized natural gas will pass outwardly of the second heat exchanger 16 through vaporized gas outlet 62.

Because of the heat transfer between the hot circulating fluid and the liquefied natural gas, a cold circulating fluid will pass through cold circulating fluid outlet 68 from the second heat exchanger 16. The warm circulating fluid will be directed in a cross-current flow on the outside of the tubes 52 of the second heat exchanger 16. The cold circulating fluid will leave the shell 60 of the second heat exchanger 16 through pipe 64 and is directed to the first heat exchanger 14. The cool circulating fluid will be directed into the first heat exchanger 14 through cold circulating fluid inlet line 66. In this manner, the cold circulating fluid pipe 64 is once again heated by the heated water passing through coil 30 in the first heat exchanger 14. A surge tank 68 is provided so as to supply, receive or accumulate the circulating fluid as required. To the extent additional circulating fluid is required for the operation of the process 10 of the present invention, pump 46 will draw required quantities of the circulating fluid from the surge tank 68, as needed.

As used herein, the circulating fluid can be a water/glycol mixture or solution. The water should be fresh water.

Even in warm climates, such as that of the southern United States, the process 10 of the present invention cannot work all year around. In the months of November through March, the ambient air is too cold to provide an economical way for heating the water. Therefore, in winter seasons, at least partial supplemental firing of the boiler 70 is required so as to assure continuous operation throughout the year. The boiler 70 is of a known technology and has been commonly used in the past for the heating of the circulating fluid. As can be seen in FIG. 1, the cold circulating fluid will pass through line 64 to the inlet 72 of the boiler 70. A suitable gas, such as a small portion of the vaporized gas from the second heat exchanger 16, can be utilized so as to provide for the firing of the boiler 70 with natural gas for the heating of the circulating fluid. The heated circulating fluid is then passed through the outlet 74 of the boiler 70 and is passed directly and solely, or in combination with circulating fluid as heated by the heated water from the water tower 12, to the inlet side of the second heat exchanger 16.

The present invention is particularly novel in that the water tower 12 is normally used to cool circulating cooling water in many installations. It is not believed that such "towers" have ever been used for the purpose of warming cold water. Contrary to the application of the water tower as a cooling water tower, in which a water loss occurs continuously from vaporizing circulation water, there is no water loss in the process 10 of the present invention. To the contrary, because the water is colder than the ambient air, water from the moisture of the air condenses and increases the water inventory continuously. The water has to be drawn off continuously as an overflow quantity and can be used as fresh water after very minimal water treatment.

Table 1, as shown hereinafter, is an energy and process chart showing the operation of the present invention. As can be seen the use of ambient air for the purposes of elevating the temperature of liquefied natural gas is significantly beneficial.

TABLE 1

| Description | Units | Examp. 1 | Examp. 2 | Examp. 3 | Examp. 4 |
|---|---|---|---|---|---|
| LNG Vaporizers | Units operating | 6 | | | |
| Heat Transferred | MMBTU/hr | 617.4 | 930 | 823 | 847 |
| LNG Flow Rate | lb/hr | 2,213,200 | 3,018,000 | 2,937,500 | 3,018,000 |
| Natural Gas Flow Rate | MMSCF/day | 1,100 | 1,500 | 1,460 | 1,500 |
| LNG Temperature in | deg. F. | −244 | −244 | −244 | −244 |
| Natural Gas Temperature out | deg. F. | 29 | 59 | 29 | 29 |
| Water/Glycol Flow Rate | gal/minute | 90,300 | 90,300 | 90,300 | 90,300 |
| Water/Glycol Temperature in | deg. F. | 44 | 64 | 49 | 44 |
| Water/Glycol Temperature out | deg. F. | 29 | 42 | 29 | 29 |
| Intermediate Exchangers | Units operating | 8 | 8 | 8 | 8 |
| Heat Transferred | MMBTU/hr | 617.4 | 930 | 823 | 351 |
| Water/Glycol Flow Rate | gal/minute | 90,300 | 90,300 | 90,300 | 51,100 |

TABLE 1-continued

| Description | Units | Examp. 1 | Examp. 2 | Examp. 3 | Examp. 4 |
|---|---|---|---|---|---|
| Water/Glycol Temperature in | deg. F. | 29 | 42 | 29 | 29 |
| Water/Glycol Temperature out | deg. F. | 44 | 64 | 49 | 44 |
| Circul. Water Flow Rate | gal/minute | 82,700 | 85,600 | 82,700 | 46,800 |
| Circul. Water Temperature in | deg. F. | 50 | 70 | 55 | 50 |
| Circul. Water Temperature out | deg. F. | 35 | 48 | 35 | 35 |
| Water Tower | Units operating | 1 | 1 | 1 | 1 |
| Number of Tower Cells/Fans | | 12 | 12 | 12 | 6 |
| Tower Height | Feet | 54 | 54 | 54 | 54 |
| Air Temperature, Wet Bulb | deg. F. | 59 | 75 | 65 | 53 |
| Air Temperature, Dry Bulb | deg. F. | 65 | 68 | 72 | 58 |
| Air Temperature, out | deg. F. | 44 | 48 | 46 | 44 |
| Circul. Water Flow Rate | gal/minute | 82,700 | 85,600 | 82,700 | 46,800 |
| Circul. Water Temperature in | deg. F. | 35 | 42 | 35 | 35 |
| Circul. Water Temperature out | deg. F. | 50 | 70 | 55 | 50 |
| Heat Transferred | MMBTU/hr | 617.4 | 930 | 823 | 351 |
| Moisture Condensation | gal/hour | 28,270 | 52,300 | 48,900 | 10,300 |
| Water boilers | Units operating | 1 | 0 | 2 | 7 |
| Heat Transferred | MMBTU/hr | 59 | | 85.9 | 579 |
| Water/Glycol Flow Rate | gal/minute | 2,300 | | 2,600 | 17,500 |
| Water/Glycol Temperature in | deg. F. | 110 | | 110 | 110 |
| Water/Glycol Temperature out | deg. F. | 180 | | 180 | 180 |

Example 1: Design case for Water Tower, LNG Vaporizers and Intermediate Exchangers
Example 2: Hot Season, no boiler operation
Example 3: Air temperature warmer than design
Example 4: Air temperature colder than design.

The present invention achieves significant advantages over the prior art. In particular, in hot weather environments, the present invention utilizes the ambient air for the purposes of elevating the water temperature. As a result, the present invention avoids the use of natural gas for the purposes of temperature elevation. This can result in a significant energy cost benefit over existing systems.

The foregoing disclosure and description of the invention is illustrative and explanatory thereof. Various changes in the details of the illustrated system or in the steps of the described process can be made within the scope of the appended claims without departing from the true spirit of the invention. The present invention should only be limited by the following claims and their legal equivalents.

I claim:

1. A process for vaporizing liquefied natural gas comprising:

passing water into a water tower so as to elevate a temperature of the water, said step of passing water comprising:

distributing the water over an interior surface of the water tower; and drawing ambient air through the water tower across the distributed water so as to transfer heat from ambient air to the water;

pumping the elevated temperature water through a first heat exchanger;

passing a circulating fluid through the first heated exchanger so as to transfer heat from the elevated temperature water into said circulating fluid;

passing the liquefied natural gas into a second heat exchanger;

pumping the heated circulating fluid from the first heat exchanger into the second heat exchanger so as to transfer heat from the circulating fluid into the liquefied natural gas; and discharging vaporized natural gas from the second heat exchanger.

2. The process of claim 1, further comprising:

condensing moisture from the air into said water tower; and draining the condensed moisture from said water tower.

3. The process of claim 1, further comprising:

exhausting cooled air from a top of said water tower after the ambient air is drawn across the distributed water.

4. The process of claim 1, further comprising:

forming the water tower having a plurality of baffles formed therein, said water tower having a blower at a top thereof, said water tower having a plurality of openings formed in a wall thereof adjacent respectively said plurality of baffles, said step of drawing ambient air comprising passing the ambient air through said plurality of openings so as to be in close proximity to the water distributed over said plurality of baffles.

5. The process of claim 4, said step of forming the water tower comprising:

securing a water basin to a bottom of said water tower, said water basin positioned so as to collect the heated distributed water, said step of pumping the elevated temperature water comprising pumping the heated distributed water from said water basin to said first heat exchanger.

6. The process of claim 1, further comprising:

pumping the water from said first heat exchanger to said water tower after the heat is transferred into the circulating fluid.

7. The process of claim 1, said second heat exchanger being a shell-and-tubes heat exchanger, said heat circulating fluid passing within the shell and across the tubes of said second heat exchanger, said liquefied natural gas passing through the tubes in said second heat exchanger.

8. The process of claim 1, further comprising:

pumping the circulating fluid from said second heat exchanger to said first heat exchanger after the heat is transferred from said circulating fluid into the liquefied natural gas.

9. A process for vaporizing liquefied natural gas comprising:

passing water into a water tower so as to elevate a temperature of the water;

pumping the elevated temperature water through a first heat exchanger;

passing a circulating fluid through the first heated exchanger so as to transfer heat from the elevated temperature water into said circulating fluid;

passing the liquefied natural gas into a second heat exchanger;

pumping the heated circulating fluid from the first heat exchanger into the second heat exchanger so as to transfer heat from the circulating fluid into the liquefied natural gas;

discharging vaporized natural gas from the second heat exchanger;

heating another quantity of circulating fluid by a heating source other than the water tower, said heating source being a gas-fired boiler; and passing the heated another quantity of circulating fluid into said second heat exchanger, said step of discharging vaporized natural gas comprising:

passing a portion of the discharged natural gas to said heating source; and firing said portion of the discharged natural gas so as to heat said another quantity of circulating fluid.

10. A process for vaporizing liquefied natural gas comprising:

passing water into a water tower so as to elevate a temperature of the water, said step of passing water comprising:

distributing the water over an interior surface of the water tower; and drawing ambient air through the water tower across the distributed water so as to transfer heat from ambient air to the water, the ambient air having a dry bulb air temperature in excess of 73° F.;

pumping the elevated temperature water through a first heat exchanger;

passing a circulating fluid through the first heated exchanger so as to transfer heat from the elevated temperature water into said circulating fluid;

passing the liquefied natural gas into a second heat exchanger;

pumping the heated circulating fluid from the first heat exchanger into the second heat exchanger so as to transfer heat from the circulating fluid into the liquefied natural gas; and discharging vaporized natural gas from the second heat exchanger.

11. A process for vaporizing liquefied natural gas comprising:

passing water into a water tower so as to elevate a temperature of the water, said water being fresh water;

pumping the elevated temperature water through a first heat exchanger;

passing a circulating fluid through the first heated exchanger so as to transfer heat from the elevated temperature water into said circulating fluid, said circulating fluid being glycol;

passing the liquefied natural gas into a second heat exchanger;

pumping the heated circulating fluid from the first heat exchanger into the second heat exchanger so as to transfer heat from the circulating fluid into the liquefied natural gas; and discharging vaporized natural gas from the second heat exchanger.

12. A system for vaporizing liquified natural gas comprising:

a water tower means having a water inlet line and a water outlet line, said water tower means for heating water passed from said water inlet line therein such that heated water passes to said water outlet line, said water tower means comprising:

a chamber having a plurality of baffles therein, said water inlet line positioned so as to distribute the water onto to said plurality of baffles;

a blower means affixed to a top of said chamber for drawing ambient air across the water on said plurality of baffles; and a water basin positioned at a bottom of said chamber, said water outlet line connected to said water basin;

a first heat exchange means connected to said water outlet line such that the heated water passes therethrough, said first heat exchange means having a circulating fluid line extending therein in heat exchange relationship with said water outlet line, said first heat exchange means for transferring heat from the heated water in said water outlet line into the circulating fluid in said circulating fluid line; and a second heat exchange means having a liquefied natural gas line therein, said circulating fluid line extending in said second heat exchange means in heat exchange relationship with said liquefied gas line, said second heat exchange means for transferring heat from the heated circulating fluid into the liquefied natural gas in said liquefied natural gas line, said second heat exchange means having a vaporized gas outlet extending therefrom.

13. The system of claim 12, said first heat exchange means having a cooled water outlet, said cooled water outlet in communication with said water inlet line.

14. The system of claim 12, said second heat exchange means having a circulating fluid outlet extending therefrom, said circulating fluid outlet communicating with said circulating fluid line in said first heat exchange means.

15. The system of claim 12, said second heat exchange means comprising a shell-and-tubes heat exchanger, said liquefied natural gas line being the tubes of said heat exchanger, the circulating fluid passing around the tubes interior of the shell, said circulating fluid line opening to the interior of said shell, said vaporized gas outlet positioned at an upper end of said heat exchanger.

16. A system for vaporizing liquified natural gas comprising:

a water tower means having a water inlet line and a water outlet line, said water tower means for heating water passed from said water inlet line therein such that heated water passes to said water outlet line;

a first heat exchange means connected to said water outlet line such that the heated water passes therethrough, said first heat exchange means having a circulating fluid line extending therein in heat exchange relationship with said water outlet line, said first heat exchange means for transferring heat from the heated water in said water outlet line into the circulating fluid in said circulating fluid line;

a second heat exchange means having a liquefied natural gas line therein, said circulating fluid line extending in said second heat exchange means in heat exchange relationship with said liquefied gas line, said second heat exchange means for transferring heat from the heated circulating fluid into the liquefied natural gas in said liquefied natural gas line, said second heat exchange means having a vaporized gas outlet extending therefrom, and a boiler means having a circulating fluid line extending therefrom to said second heat means, said boiler means for heating the circulating fluid passing to said second heat exchange means.

17. The system of claim 16, said second heat exchange means having a gas line connected thereto, said boiler means having said gas line connected thereto, said second heat exchange means for passing a portion of the vaporized gas through said gas line to said boiler means, said boiler means firing the vaporized gas so as to heat the circulating fluid in said circulating fluid line.

* * * * *